United States Patent [19]

Eickmann

[11] Patent Number: 4,635,534

[45] Date of Patent: Jan. 13, 1987

[54] PISTONS, PISTON SHOES AND ROTORS IN PUMPS AND MOTORS

[76] Inventor: Karl Eickmann, 2420 Isshiki, Hayama-machi, Kanagawa-ken, Japan

[21] Appl. No.: 603,051

[22] Filed: Apr. 23, 1984

Related U.S. Application Data

[60] Continuation-in-part of Ser. No. 118,388, Feb. 2, 1980, abandoned, which is a division of Ser. No. 765,221, Feb. 3, 1977, Pat. No. 4,193,336, which is a continuation-in-part of Ser. No. 528,346, Nov. 29, 1974, Pat. No. 4,037,523, which is a continuation-in-part of Ser. No. 372,875, Aug. 18, 1981, abandoned.

[51] Int. Cl.[4] ..... F01B 13/06

[52] U.S. Cl. ..... 91/488; 92/58

[58] Field of Search ..... 92/72, 58; 417/273; 91/484–489, 491–496, 498

[56] References Cited

U.S. PATENT DOCUMENTS

| | | | |
|---|---|---|---|
| 1,924,124 | 8/1933 | Kuzelewski | 91/496 |
| 1,930,163 | 10/1933 | Ferris | 91/496 |
| 2,386,459 | 10/1945 | Hautzenroeder | 91/498 |
| 2,621,607 | 12/1952 | Trapp | 417/273 |
| 3,063,380 | 11/1962 | Strickland | 92/58 |
| 3,570,372 | 3/1971 | Campbell | 91/496 |
| 3,750,533 | 8/1973 | Thoma | 91/498 |
| 3,885,457 | 5/1975 | Bosch | 91/488 |

FOREIGN PATENT DOCUMENTS

| | | | |
|---|---|---|---|
| 1254200 | 1/1961 | France | 91/498 |
| 2309736 | 11/1976 | France | 91/487 |
| 1244835 | 9/1971 | United Kingdom | 91/472 |
| 1326738 | 8/1973 | United Kingdom | 91/492 |
| 182463 | 7/1966 | U.S.S.R. | 91/488 |

*Primary Examiner*—Carlton R. Croyle
*Assistant Examiner*—Paul F. Neils

[57] ABSTRACT

In radial piston pumps and motors the dimensions of the rotor, pistons and piston shoes are optimized for best efficiency and power in a given size and weight. The efficiency and reliability of the piston shoes is improved by the provision of fluid pressure pockets in the outer face of the piston shoe which have cross-sectional areas exceeding the cross-sectional area of the piston whereon the piston shoe is pivotably borne. Welding of the outer face of the piston shoe is prevented and the devices are able to operate with higher pressures and rotary velocities.

1 Claim, 12 Drawing Figures

Fig. 6
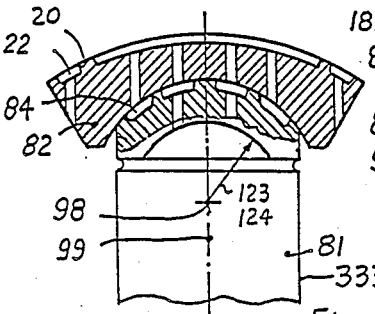
Fig. 5
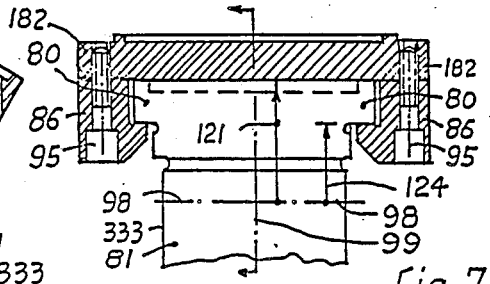
Fig. 7
Fig. 8
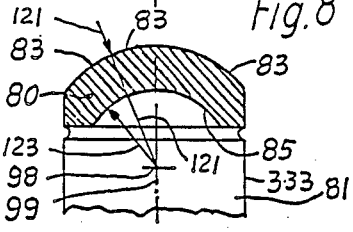
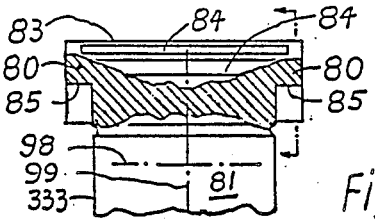
Fig. 9
Fig. 10
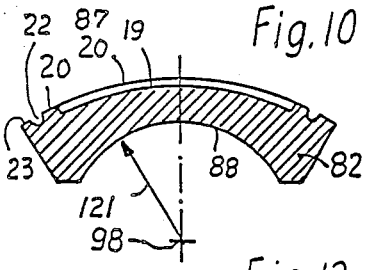
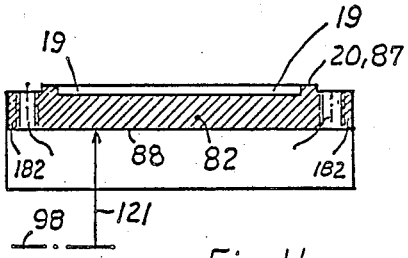
Fig. 12
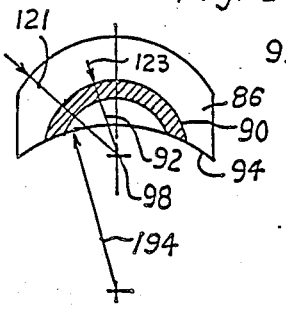
Fig. 11
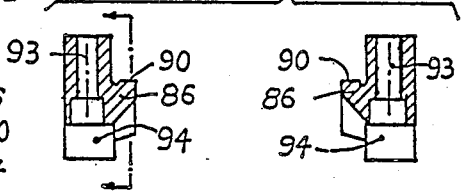

PISTONS, PISTON SHOES AND ROTORS IN PUMPS AND MOTORS

REFERENCE TO RELATED APPLICATIONS

This is a continuation in part application of my earlier application Ser. No. 118,388 filed on Feb. 2nd, 1980, now abandoned. The mentioned co-pending application No. 118,388 was a divisional application of that time co-pending application Ser. No. 765,221, filed on Feb. 3rd, 1977 and issued on Mar. 18, 1980 as U.S. Pat. No. 4,193,336; as a continuation in part application of the that time co-pending application Ser. No. 528,346, filed on Nov. 29th, 1974, and issued on July 26th, 1977 as U.S. Pat. No. 4,037,523. This is also a continuation in part application of my earlier application Ser. No. 06-372,875 which was filed on Aug. 18, 1981 and which is now abandoned. Benefits of the above applications are claimed.

BACKGROUND OF THE INVENTION

1. Field of the Invention

This invention relates to fluid handling devices, wherein fluid flows through working chambers in a rotor which periodically take in and expel said fluid. Such devices commonly act as pumps, motors or transmissions. The more specific field of the invention is concerned with radial piston pumps and motors, as well as the rotors, pistons and piston shoes therein.

2. Description of the Prior Art

A relatively reliable and high power radial piston pump is disclosed in my U.S. Pat. Nos. 3,223,046 and 3,277,834. These devices have worked satisfactory at the revolutions and pressures, which were in common use at the time of the issuances of the mentioned patents. At the higher revolutions and pressures which are now desired presently, the outer faces of the pistons and the outer faces of the pistons tended to weld, which would break the respective devices.

SUMMARY OF THE INVENTION

Applicant has had limited success in employing the previously referenced prior art patents in radial piston pumps having increased angular velocities.

This has succeeded with the limitation, that at increasing rotary angular velocities and pressures in the devices, the outer faces of the piston shoes often welded and occasionally also the outer faces of the pistons welded in the respective cylinders. The reasons for these unwanted appearances were assumed at different places, but the real reasons were never found. It has now been found by this present invention, that the reason for the welding of the outer faces of the piston shoes is often, that the fluid pressure pockets are dimensioned to be about 85 to 98 percent of the cross-sectional area of the respective piston. The invention discovers, that this cross-sectional area of the fluid pressure pockets is much too small for high rotary velocity operations. Additionally, occasional welding of the pistons in the cylinder has also caused the employment of small diameters for the radial extensions and segments of the rotors. The latter lack of reliability has also led to deformations of the piston shoes, which led partially also to the welding of the outer faces of the piston shoes, because the medial bar of the piston shoes became too narrow by the requirement to pivot in the slots between the segments of the rotor.

It is therefore the object of this invention, to overcome the difficulties of the prior art and to provide the means to overcome the difficulties of the former art in the field of the art.

The detailed objects of the invention therefore deal with the more outward location of the pivot centers, the enlargement of the fluid pressure balancing pockets in the outer faces of the piston shoes and in related means to get piston shoes, pumps and motors which are capable of higher rotary angular velocities and pressures. Thereby the devices of the invention obtain higher efficiencies and power.

The details which are provided by the object or different objects of the invention will become apparent in more detail in the description of the preferred embodiments.

BRIEF DESCRIPTION OF THE DRAWINGS

FIG. 5 is a longitudinal sectional view through another embodiment.

FIG. 6 is a cross-sectional view along the arrow through FIG. 5.

FIGS. 7 to 12 show sectional views through parts of FIGS. 5 and 6 in separate demonstrations.

DESCRIPTION OF THE PREFERRED EMBODIMENTS

Figure 2:
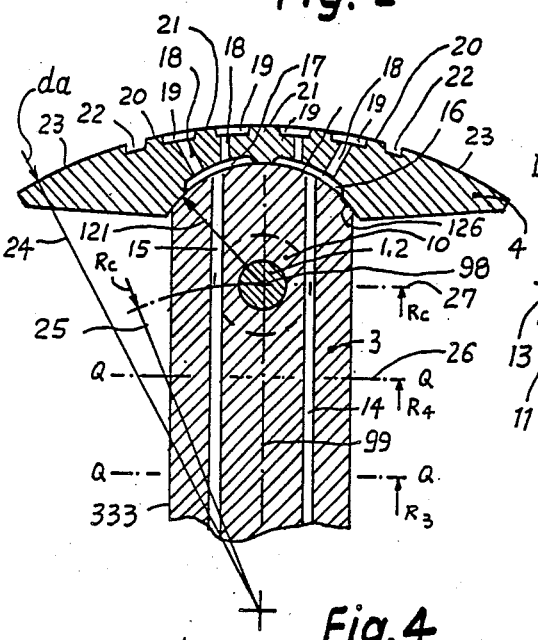
FIG. 2 is a sectional view through FIG. 1 along the arrow II—II.
Figure 1:
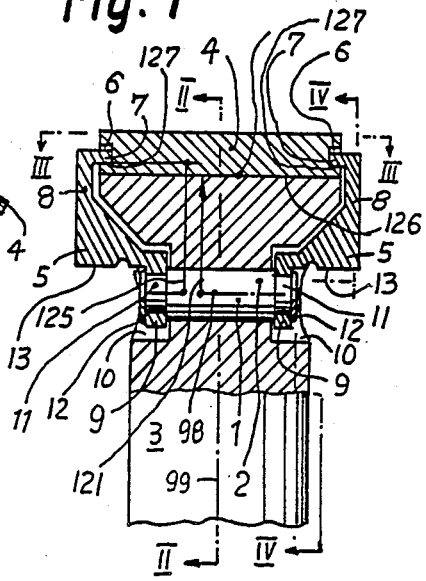
FIG. 1 is a longitudinal sectional view through a piston and a piston shoe of the invention, partially seen from the outside.
Figure 4:
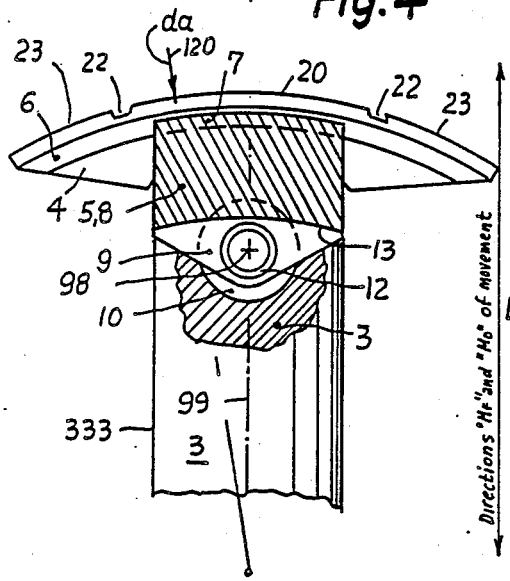
FIG. 4 is a view onto FIG. 1 and partially a sectional view through FIG. 1 along the arrow IV—IV.
Figure 3:
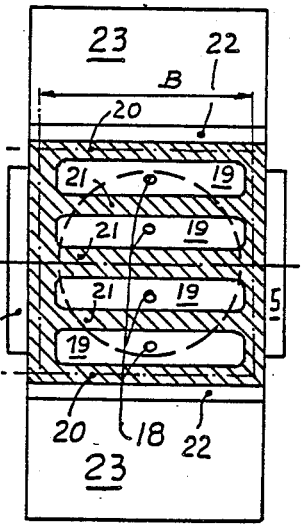
FIG. 3 is a view from top onto FIG. 1, and partially a sectional view along arrow III—III of FIG. 1.

In FIGS. 1 to 4 there are two important objects of the invention shown in specific arrangements of the invention. These objects are:

The first object is, to provide a proper dimensioning of the cross-sectional areas through the fluid pressure pocket(s) and the sealing land(s) there around which provide a high pressure area, in order to make the outer face of a piston shoe capable of operating smoothly at higher pressures and rotary velocities of the rotor of the device, while the second object is, to provide a proper bearing face on the piston head to permit the piston and shoe to carry a higher radial load, while at the same time the arrangement provides a means to prevent escape of the piston shoe from the bearing bed of the piston.

To obtain these objects, the cross-sectional area through the high pressure area of the outer face 20 of the piston shoe 4 is extended to exceed the cross-sectional area "Q" of the piston 3, whereon the piston shoe 4 is borne. This makes possible a high rotary revolution of the rotor, because the piston shoe outer face becomes thereby capable of acting against the centrifigal forces of the piston 3 and shoe 4. The load between the outer face 20 of the piston shoe and the guide face of the piston stroke actuator means is thereby reduced, which prevents the welding, excessive friction and wear between the piston shoe and the piston stroke guide face of the device.

The piston has a first longitudinal axis 99 and a bore 1 which crosses the mentioned first axis and is provided around a second axis 98, which is normal to the first axis and extends through the first axis 99.

A pin 2 is extended through the bore 1 and extends out therefrom. A pair of holding bodies 5 is located laterally of the piston 3 and shoe 4 and provided with bores, whereinto the pin 2 extends. Pin 2 may have outer ends of a smaller diameter, shown by 11 fitting in the bores 11 of the holding body 5. The pin 2 may on its ends be riveted on the respective inner portions 9 of the holding bodies 5. A respective pair of annular spaces 10 may be provided to permit the entrance of the inner portions 9 into the outer defines of the piston 2. A medial portion 8 may extend radially outwardly from the inner portion of the respective holding body 5 to end in a respective embracement portion 7, which enters into a respective recess 6 which is provided in the lateral end of the piston shoe 4. Thus, there are at least two recesses 6 and at least two portions 7 which enter into the recesses 6. Respective faces may be formed with a radius 125 around the mentioned second axis, whereby the piston shoe is completely kept and pivotable on the piston bed of piston 3.

To increase the bearing capacity of the piston bed, the piston bed is formed as a bearing bed face 16 of a radius 121 around the mentioned second axis 98. The radius 121 is relatively large in order to obtain a bearing face 16 of a curvature which permits the main portion of the radial load to act substantially normal to the radial direction of the load. The piston shoe 4 has a respective pivot face 126 which is borne on the mentioned bearing bed face and which pivots thereon. This arrangement increases the capability of carrying of load, because the area of the bed face 16 and of the pivot face 126 is now much larger than in the former art and the portion of the load borne by a radial direction and substantially normal to the load is now much higher than in the former art. The embodiment of FIGS. 5 and 6 whereof the respective parts are separately shown in FIGS. 7 to 12 demonstrates a piston-piston shoe arrangement for extremely high pressures in fluid. While in common hydrostatic pumps and motors the pressures remained below approximately 7000 psi, it is presently required occasionally to use pressures of 15,000 psi. Occasionally even 60,000 psi is required.

In cases of such high pressures, it is not possible any more to bear the piston shoe in a bed in the piston. On the contrary, as the present invention discovered, the piston must then not be borne only upon the piston, but the piston head must even become enlarged for the provision of a bearing bed face of large bearing face area. Because without a great enough bearing face, the faces between the piston and shoe would weld at the pivotal movement.

In the embodiment of these Figures the piston head is therefore provided with lateral piston head extensions 80 in both directions parallel to the second axis 98. When the pressure desired, is not so very high, the lateral extensions 80 of the piston head may be spared. In any case however, a part-cylindrical bearing bed face 83 of a constant first radius 121 around the second axis 98 is provided on the piston head. The piston head is further provided with laterally located retaining faces 85 of a third radius 123 around the second axis 98.

The piston shoe has the outer face 20,87 for sliding along a respective guide face "da" of a piston stroke guide actuator. The piston shoe has further the inner face 88 of hollow part-cylindrical configuration of a second radius 121 around said second axis 98, whereby the second radius is substantially equal to the mentioned first radius 121 of the bed face 83 of the piston head 80,83.

The piston head is also provided with retaining faces 85 of third radii 123 around the mentioned second axis.

In order to fasten the piston shoe onto the piston, there is a pair of retaining members 86 provided. Retaining members 86 have an outer face of partcylindrical configuration with radius 121 around the second axis 98 in order to be fastened therewith onto the inner face 88 of the piston shoe. The outer faces of the retaining members could however also be formed otherwise and be of other sizes, if so desired. In any case however, the retaining members 86 are provided with holding faces 90 of part-cylindrical configuration with fourth radii 92 around the mentioned second axis 98. These fourth radii 92 are substantially equal to the third radii 123 of the mentioned retaining faces 85 of the piston head.

For mounting the piston shoe 82 onto the piston 81, the piston shoe 82 is laid with the inner face 88 upon the bearing bed face 83 of the piston 81. The retaining members 86 are then moved parallel to the second axis 98 into place, where the holding faces 90 are meeting the retaining faces 85. The retaining members 86 are then fastened to the piston shoe 82, for example, by bolts or rivets 95.

The embodiment of FIGS. 5 to 12 may also be described by the following definition:

The device of FIGS. 5 to 12, in which the device includes a piston 81 and a piston shoe 82, the piston forms a piston head and the piston shoe forms an inner face 88 and an outer face 20,87, the piston head forms a part cylindrical bearing face 83 of a constant first radius 121 around a second axis 98 of normal direction relative to a first axis 99 longitudinally through the piston 81, the inner face forms a hollow part-cylindrical face 88 of a second radius 121 substantially equal to the first radius, whereby the inner face 88 may lay upon said bearing bed face 83 and be able to pivot thereon, the outer face 20,87 of the piston shoe 82 is able to slide along a respective guide face "da" of a piston stroke guide 44, the piston head 80 forms retaining faces 85 of third radii 123 around the second axis 98, retaining members 86 are fastend to the piston shoe 82 and include holding faces 90 of fourth radii 92 around the second axis 98, substantially equal to the third radii 123 whereby the holding faces 90 are able to slide along the retaining faces 85, when the piston shoe 82 pivots on the piston head 80,83, whereby the piston and piston shoe are fastened together by said retaining members 86 with the retaining faces 85 and the holding faces 90 of said piston 81 and retaining member 86; and;

wherein the piston 81 forms a cylindrical outer face 333 around the first axis 99, the piston head forms lateral extensions 80 parallel to the second axis 98 and extending beyond the outer diameter 333 of the piston 81 whereby the part cylindrical bearing face 83 extends along the entirety of the piston head 80 with its lateral extensions 80 and thereby beyond the outer diameter 333 of the piston 81, the piston shoe 82 extends laterally beyond the extension 80 of the piston head to form reception portions 182 for the fastening of the retaining members 86 thereon;

the retaining faces 85 of the piston head 80 are formed on the lateral extensions 80, the retaining members 86 are located laterally of the piston head 80 and of the outer diameter 333 of the piston 81; and; in which traction faces 94 may be provided on the retaining members to permit a respective traction means 55 to thrust against the traction faces 94 to move the piston shoe 82 and piston 81 in an outward stroke in the cylinder 40.

What is claimed, is:

1. A hydraulic device including a housing with a rotor revolvingly borne in said housing and provided with working chambers which are subjected to a displacement member for enlarging and reducing said chambers for the reception and expulsion of a fluid and control means provided in said device for the control of flow of fluid and for the control of the movements of said displacement members, wherein said device includes a piston and a piston shoe, said piston forms a piston head and said piston shoe forms an inner face and an outer face, wherein said piston head forms a part cylindrical bearing face of a constant first radius around a second axis of normal direction relatively to a first axis longitudinally through said piston, wherein said inner face forms a hollow part-cylindrical face of a second radius substantially equal to said first radius, whereby said inner face may lay upon said bearing face and is able to pivot thereon, wherein said outer face of said piston shoe is able to slide along a respective guide face of a piston stroke guide, wherein said piston head forms retaining faces of third radii around said second axis, wherein retaining members are fastend to said piston shoe and include holding faces of fourth radii around said second axis substantially equal to said third radii, whereby said holding faces are able to slide along said retaining faces when said piston shoe pivots on said piston head, whereby said piston and piston shoe are fastened together by said retaining members with said retaining faces and said holding faces of said piston and retaining member, wherein said piston forms a cylindrical outer face around said first axis, wherein said piston head forms lateral extensions parallel to said second axis and extending beyond the outer diameter of said piston whereby said part cylindrical bearing face extends along the entirety of said piston head with its lateral extensions and thereby beyond the outer diameter of said piston, wherein said piston shoe extends laterally beyond said extensions of said piston head to form reception portions for the fastening of said retaining members thereon, wherein said retaining faces of said piston head are formed on said lateral extensions, whereby said retaining members are located laterally of said piston head and of said outer diameter of said piston, wherein passages are extended through said piston to meet passage means which extend through said piston shoe;

wherein fluid pressure balancing pockets are provided in the radial outer face of said piston shoe and fluid pressure pockets are also provided in and through at least one face of the bearing bed whereon the piston shoe pivots on said piston while said passage and said passage means communicate from said cylinder to said fluid pressure pockets;

wherein sealing lands surround and seal said fluid pressure pockets to form with said fluid pressure pockets hydrostatic bearings between the guide face of the piston stroke guide wherealong the radial outer face of the piston shoe slides and between the faces of the bearing bed for the pivotal movement of the piston shoe on the said bearing bed of said piston, and;

wherein the areas of said hydrostatic bearings exceed the cross-sectional area of said piston, whereby said hydrostatic bearings are of such a large area that the sealing lands and guide portions of the pivot face and of the radial outer slide face of the piston shoe remain at all times loaded with a force per area which never exceeds the pressure per area in the fluid which flows through the cylinders of said device.

* * * * *